US007614621B2

(12) United States Patent
Asada

(10) Patent No.: US 7,614,621 B2
(45) Date of Patent: Nov. 10, 2009

(54) FEEDING APPARATUS AND IMAGE RECORDING APPARATUS

(75) Inventor: Tetsuo Asada, Kuwana (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 134 days.

(21) Appl. No.: 11/614,787

(22) Filed: Dec. 21, 2006

(65) Prior Publication Data

US 2007/0145670 A1 Jun. 28, 2007

(30) Foreign Application Priority Data

Dec. 26, 2005 (JP) ..... 2005-372558

(51) Int. Cl.
*B65H 3/06* (2006.01)

(52) U.S. Cl. ..... 271/117; 271/118

(58) Field of Classification Search ..... 271/117, 271/118

See application file for complete search history.

(56) References Cited

U.S. PATENT DOCUMENTS 4,202,621 A * 5/1980 Yoshimura et al. ..... 399/407
5,154,406 A * 10/1992 Bauer ..... 271/11
2003/0184004 A1* 10/2003 Shiohara et al. ..... 271/121
2005/0029732 A1* 2/2005 Chang ..... 271/113
2005/0194733 A1 9/2005 Asada

FOREIGN PATENT DOCUMENTS

JP 2000-233836 A 8/2000
JP 2002-211767 A 7/2002
JP 2003146455 A * 5/2003
JP 2005-247539 A 9/2005

* cited by examiner

*Primary Examiner*—Patrick H Mackey
*Assistant Examiner*—Ernesto Suarez
(74) *Attorney, Agent, or Firm*—Baker Botts, LLP

(57) ABSTRACT

A feeding apparatus, includes: a housing part which houses stacked sheets and has, a separating part which separates said sheets one by one; an arm member which is capable of pivoting about its one end, in accordance with the amount of said stacked sheets; and a first feeder rotating body disposed far from said one end and a second feeder rotating body disposed closer to said one end than is said first feeder rotating body, which are mounted to said arm member, abut on a top surface of said sheets, and separate and feed said sheets one by one while cooperating with said separating part. Which of said first feeder rotating body and said second feeder rotating body abuts on the top surface of said sheets depending on the amount of said stacked sheets.

13 Claims, 6 Drawing Sheets

FEEDING APPARATUS AND IMAGE RECORDING APPARATUS

CROSS-REFERENCE TO RELATED APPLICATIONS

This Nonprovisional application claims priority under 35 U.S.C. §119(a) on Patent Application No. 2005-372558 filed in Japan on Dec. 26, 2005, the entire contents of which are hereby incorporated by reference.

BACKGROUND

The present invention relates to a feeding apparatus which separates stacked sheets one by one and feeds each sheet and an image recording apparatus which comprises such a feeding apparatus.

A conventional image recording apparatus, such as various types of printers and facsimile machines, comprises a feeding apparatus which houses in its sheet feeder cassette plural stacked recording sheets, separates the sheets one by one as a sheet feeder roller rotates and feeds each sheet to an image recording part.

In the feeding apparatus which is described in Japanese Patent Application Laid-open No. 2000-233836 for instance, a drive shaft is disposed above a sheet feeder cassette along the perpendicular direction to a sheet feeding direction and an arm member is attached to the drive shaft in such a manner that the arm member can rotate. A distal end of the arm member extends toward a direction which is close to a slanted separating part which is disposed at one end of the sheet feeder cassette, and a sheet feeder roller which feeds sheets stacked in the sheet feeder cassette is attached to the distal end of the arm member. An urging spring urges the arm member so that the sheet feeder roller always stays in contact with the top surface of the stacked sheets regardless of the amount of the sheets stacked up in the sheet feeder cassette, and the sheet feeder roller is driven to rotate by the drive shaft via a gear drive transmission mechanism which is attached to the arm member.

In the structure above, when the sheet feeder roller rotates in a predetermined direction, plural sheets on the sheet feeder cassette are fed, and only the top one of the sheets gets separated when passing the slanted separating part.

SUMMARY

By the way, in a feeding apparatus as that described above, a sheet feeder roller 102 disposed to a distal end of an arm member 100 which pivots about a drive shaft 101 is always urged so as to abut on the surface of the top sheet 103 as shown in FIG. 1. Hence, in the event that the amount of the stacked sheets 103 is great, the tilt angle of the arm member 100 with respect to the surface of the sheet 103 (i.e., to be precise, the contained angle a between the surface of the sheet 103 and a line connecting the pivot center of the arm member 100 to a point at which the sheet feeder roller 102 abuts on the surface of the sheet 103) is small, and the tilt angle (the contained angle $\alpha$) grows as the amount decreases.

Depending upon the tilt angle (the contained angle $\alpha$) of the arm member 100, the contact pressure of the sheet feeder roller 102 upon the sheets 103 and the grip force of the sheet feeder roller 102 upon the sheets 103 change. In other words, when the amount of the stacked sheets 103 is great (i.e., when the tilt angle (the contained angle $\alpha$) is small), the grip force is weak and the contact pressure decreases, whereby idle feeding of the sheets 103 tends to occur. On the contrary, when the amount of the stacked sheets 103 is small (i.e., when the tilt angle (the contained angle $\alpha$) is large), the grip force is strong and the contact pressure increases, whereby more than one sheets 103 tend to be fed. Hence, there is a problem that the range of contained angle from the minimum optimal angle which will not cause idle sheet feeding to the maximum optimal angle which will not cause double sheet feeding must be narrow and the full load amount of the sheets 103 is accordingly restricted.

While the one side of a bottom plate of the sheet feeder cassette, which is disposed approximately horizontally, is lifted up toward the slanted separating part according to Japanese Patent Application Laid-open No. 2000-233836 to solve the problem above, since a mechanism for lifting up is disposed between a main section of the image recording apparatus and the bottom section of the sheet feeder cassette, the structure is complex and bulky and the image recording apparatus is accordingly large.

In an attempt to solve the problems above, it is an object to provide a feeding apparatus which is capable of stably feeding stacked sheets which are housed and to provide an image recording apparatus including such feeding apparatus.

To achieve this object, a feeding apparatus according to an aspect of the invention is characterized by the feeding apparatus comprising: a housing part which houses stacked sheets and comprises, at its end in a sheet feeding direction, a separating part which separates said sheets one by one; an arm member which is capable of pivoting about its one end as a pivot center, in accordance with the amount of said stacked sheets; and a first feeder rotating body disposed far from said one end and a second feeder rotating body disposed closer to said one end than is said first feeder rotating body, said first feeder rotating body and said second feeder rotating body being mounted to said arm member, abutting on a top surface of said stacked sheets, and separating and feeding said stacked sheets one by one while cooperating with said separating part, wherein said first feeder rotating body and said second feeder rotating body are disposed in a tandem arrangement along a longitudinal direction of said arm member and driven to rotate in the same direction, and which of said first feeder rotating body and said second feeder rotating body abuts on the top surface of said sheets depending on the amount of said stacked sheets.

In the above aspect of the invention, it is possible to set, for each one of the first feeder rotating body and the second feeder rotating body, a narrow range of contained angle, which is from the minimum optimal angle which will not cause idle sheet feeding to the maximum optimal angle which will not cause double sheet feeding, and increase the full load amount of sheets which can be stacked in the housing part. In other words, even when the full load amount of the sheets which can be stacked in the housing part increases, it is possible to stably feed the sheets. Describing from the opposite perspective, when the full load amount of sheets which can be housed in the housing part is set the same as in a conventional apparatus, it is possible to set a narrow range of contained angle from the minimum optimal angle which will not cause idle sheet feeding to the maximum optimal angle which will not cause double sheet feeding, thereby attaining the effect that substantially stable sheet feeding is realized. As the structure to this effect merely requires disposing the first feeder rotating body and the second feeder rotating body in a tandem arrangement along the longitudinal direction of the arm member, there is another effect that the structure is simple.

The above and further objects and features will more fully be apparent from the following detailed description with accompanying drawings.

DETAILED DESCRIPTION OF THE EXEMPLARY EMBODIMENTS

Figure 1:
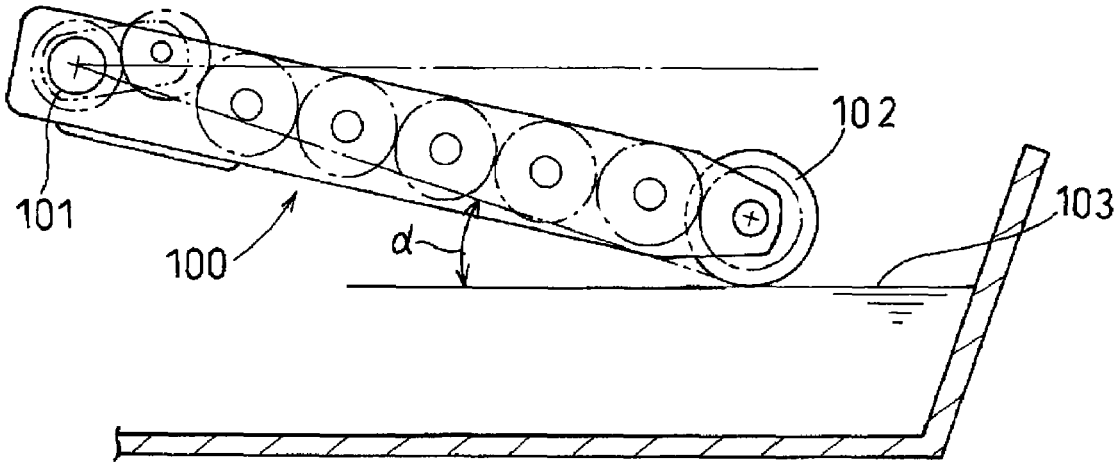
FIG. 1 RELATED ART
FIG. 1 is a drawing which shows a sheet feeding state with a known sheet feeder roller.
Figure 2:
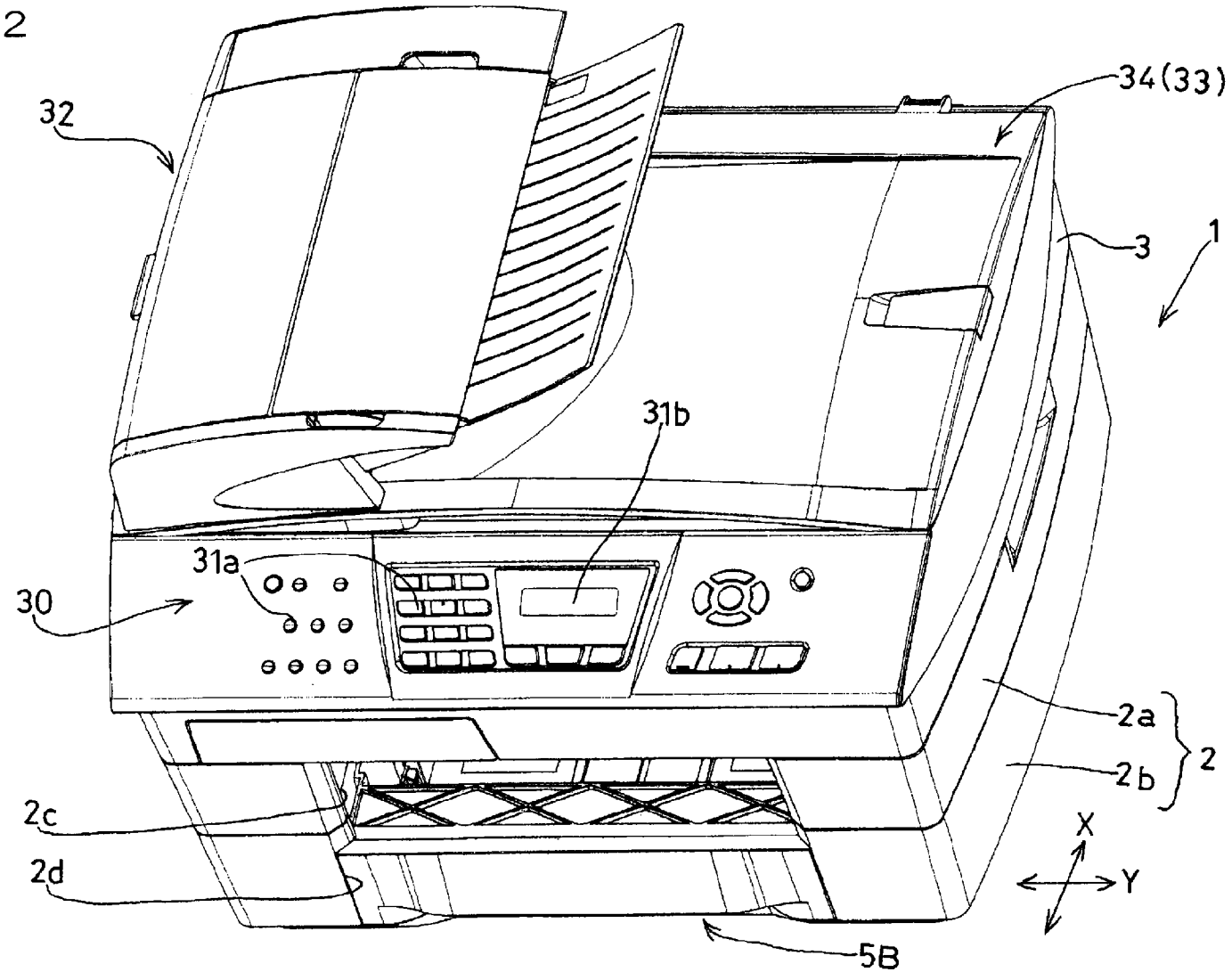
FIG. 2 is a perspective view of an image recording apparatus.
Figure 4:
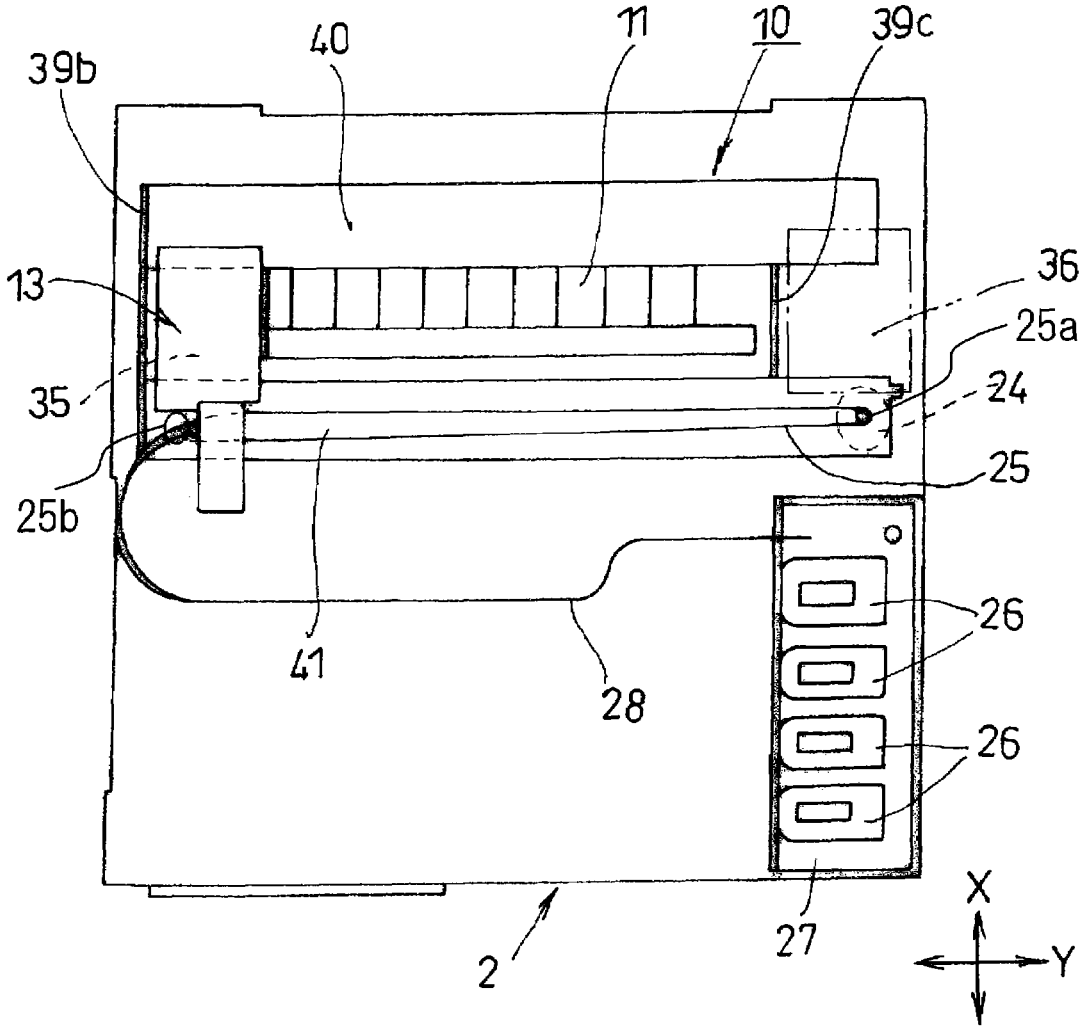
FIG. 4 is a plan view of the image recording apparatus, exclusive of an image reading apparatus.
Figure 5:
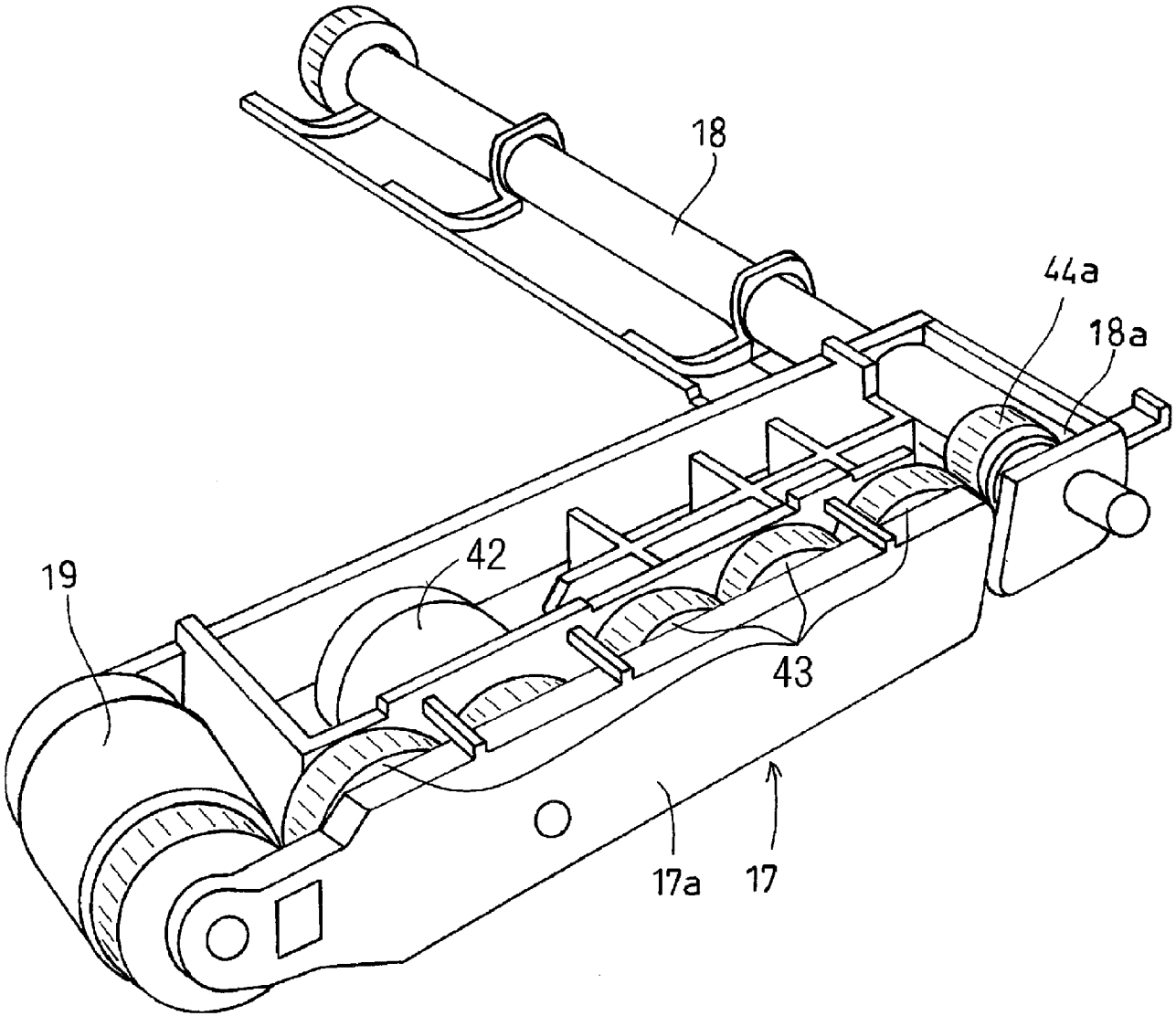
FIG. 5 is a perspective view of a second feeding unit.
Figure 6A:
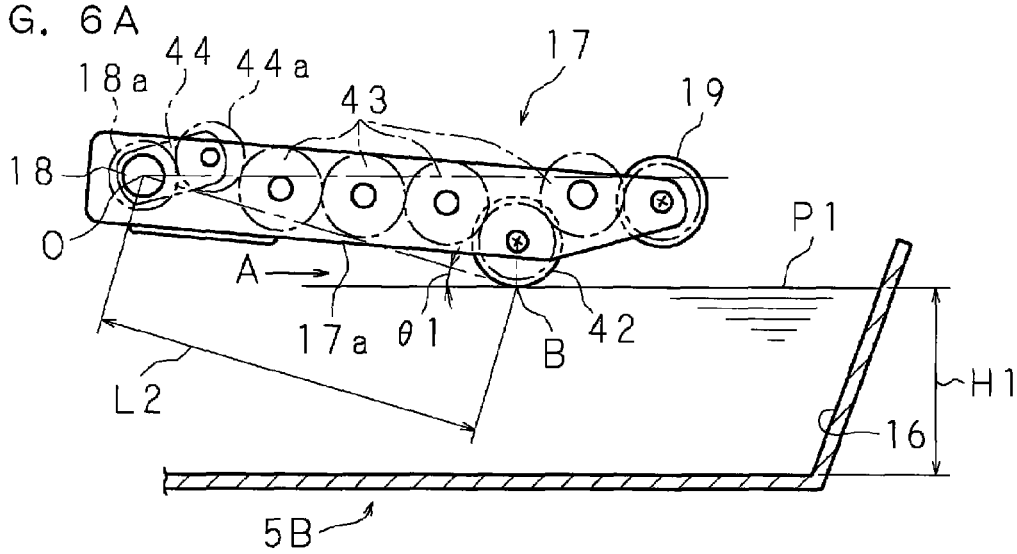
FIG. 6A is a drawing which shows a sheet feeding state only with a midstream sheet feeder roller.
Figure 6B:
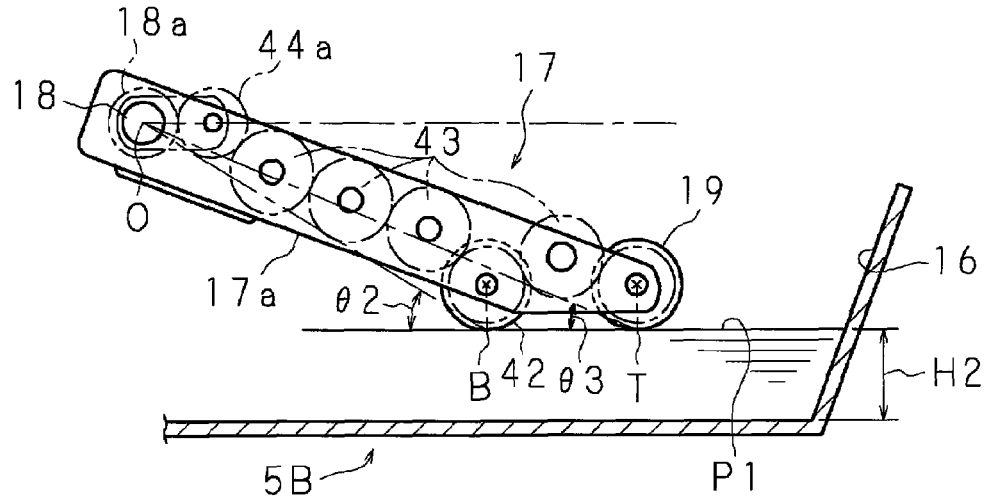
FIG. 6B is a drawing which shows a state that the midstream and a distal-end sheet feeder rollers are in contact with a sheet P1.
Figure 6C:
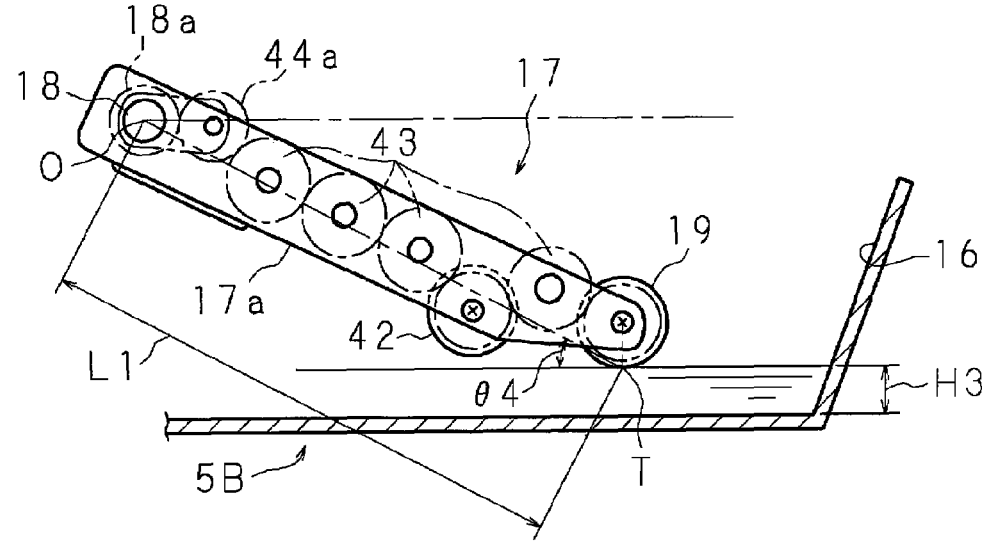
FIG. 6C is a drawing which shows a sheet feeding state only with the distal-end sheet feeder roller.

An embodiment will now be described with reference to the drawings. FIG. 2 is a perspective view of an image recording apparatus as it is viewed from the front, FIG. 3 is a side cross sectional view of a recording part and two-stage top and bottom sheet feeder cassettes, FIG. 4 is a plan view of the image recording apparatus exclusive of an image reading apparatus, FIG. 5 is a perspective view of a second feeding unit according to this embodiment, and FIGS. 6A to 6C are explanatory views for describing how the second feeding unit functions in accordance with a change of the amount of sheets which are housed in the second sheet feeder cassette.

The image recording apparatus 1 according to this embodiment is an application to an Multi Function Device (MFD) which is equipped with a printer function, a copy function, a scanner function and a facsimile function. As shown in FIG. 2, in the image recording apparatus 1, there is a top-stage first sheet feeder cassette 5A (FIG. 3) which can be inserted from an opening part 2*c* which is formed in the front side of a first bottom case 2*a* of a housing 2 which is made of a synthetic resin, and a second bottom case 2*b*, which is linked to a bottom section of the first bottom case 2*a*, as well houses a bottom-stage second sheet feeder cassette 5B which can be inserted from an opening part 2*d* which is formed in the front side. In FIG. 2, although the second sheet feeder cassette 5B is housed inside the housing 2, the first sheet feeder cassette 5A is detached from the housing 2. In the following, the side closer to the opening parts 2*c* and 2*d* will be referred to as "the front side", "the front section" or "the front edge" and the opposite side will be referred to as "the rear side", "the rear section" or "the rear edge".

Figure 3:
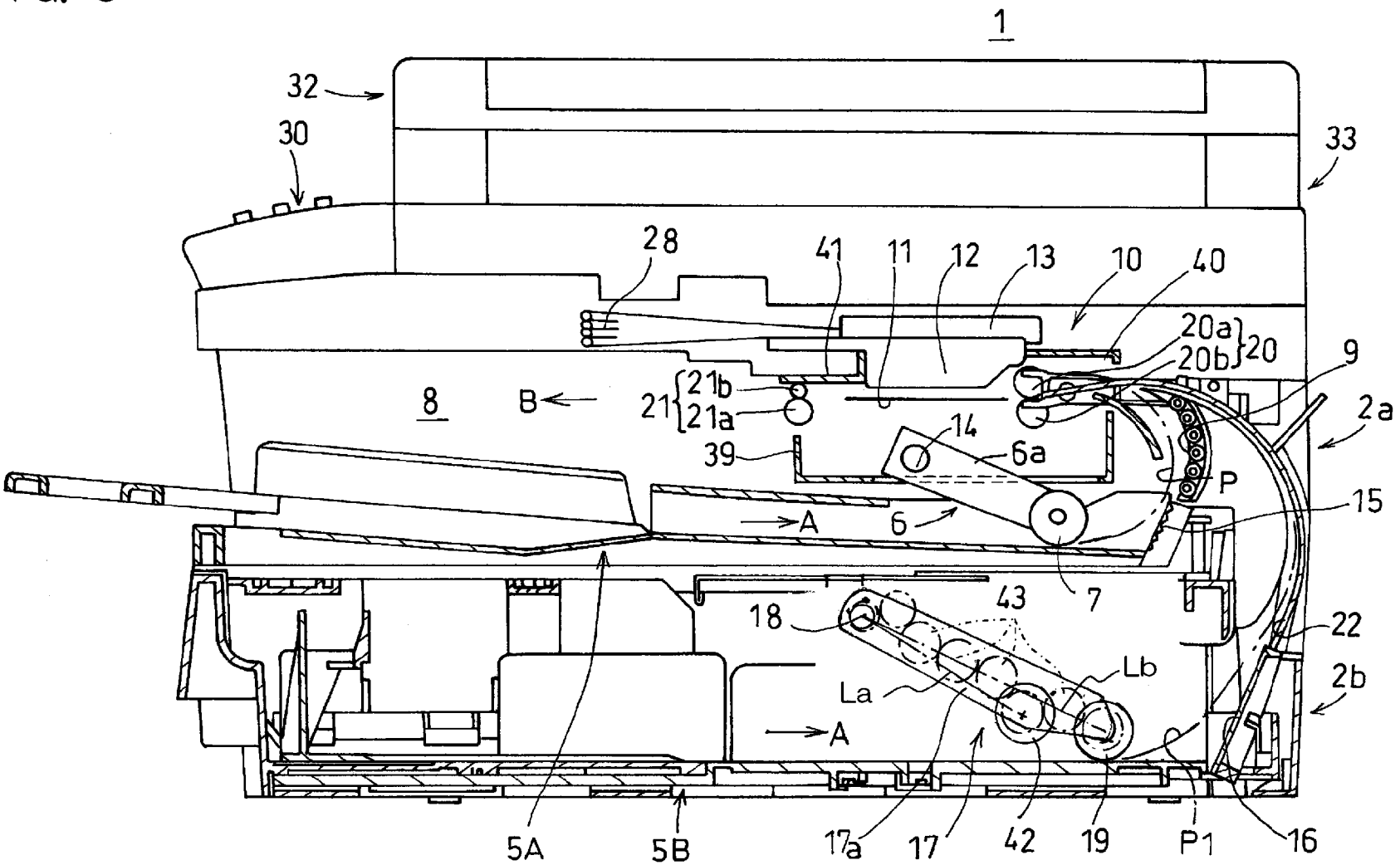
FIG. 3 is a cross sectional view of a recording part and sheet feeder cassettes.

An upper case 3 disposed above the housing 2 contains an image reading apparatus 33, which comprises an automatic document feeder 32 used for reading a document using the copy function and the facsimile function, and an operation panel 30 whose front area includes various operation buttons 31*a*, a liquid crystal display 31*b* and the like (FIGS. 2 and 3). The rear edge of a document covering member 34 covering the top surface of a document mounting glass plate (not shown) of the image reading apparatus 33 is attached to the rear edge of the image reading apparatus 33 in such a manner that the rear edge of the document covering member 34 can rotate toward above and below about hinges. Hence, after a document is set on the document mounting glass plate with the document covering member 34 opened up, an image of a document is read by a contact image sensor (CIS) (not shown), which is disposed beneath the document mounting glass plate and mounted, so as to reciprocate, to a support shaft which extends along the perpendicular direction to the plane of FIG. 3 (i.e., along a main scanning direction which is the Y-axis direction in FIG. 2).

Disposed below the operation panel 30 and the image reading apparatus 33 within their projected area in the plan view are a recording unit 10, a sheet discharging part 8 (which is a space within the opening part 2*c* above the sheet feeder cassette 5A in FIG. 3), an ink housing part 27, etc. The ink housing part 27 includes plural ink cartridges 26 which supply inks to a recording head 12 for color recording. The ink cartridges 26 house the inks of the respective associated colors which are the four colors of black, cyan, magenta and yellow in this embodiment but may house inks of more colors. From each ink cartridge 26 to the recording head 12, the ink is supplied through a flexible ink tube 28. The ink cartridges 26 can be attached to and detached from the ink housing part 27 (FIG. 4) from above, with the upper case 3 opened toward above.

As shown in FIGS. 3 and 4, the recording unit 10 serving as an image recording part comprises a carriage 13 which includes the recording head 12, a platen 11 which is made of a synthetic resin and shaped like a plate, a carriage motor (CR motor) 24 which moves the carriage 13 back and forth, a timing belt 25 which is connected with the CR motor 24 and a frame 39 which is formed by a metal plate and supports the above-mentioned components. The frame 39 having a box-shaped main section is disposed on the rear side to the housing 2 and above the sheet feeder cassette 5. As shown in FIGS. 3 and 4, mounted to an upper section of the frame 39 are paired guide plates 40 and 41 which extend along the longitudinal direction of the housing 2 (i.e., the main scanning direction, the Y-axis direction), support the carriage 13 such that the carriage 13 can slide, and are located respectively on the upstream side and the downstream side of the sheet feeding direction (which is the direction denoted at the arrow A in FIGS. 3 and 6).

The timing belt 25 extending along the main scanning direction (the Y-axis direction) is wound around pulleys 25*a* and 25*b* above the guide plate 41 which is disposed on the downstream side of the sheet feeding direction. The carriage 13 mounting the recording head 12 is linked to a part of the timing belt 25.

A strip-like linear encoder (encoder strip; not shown) which extends along the longitudinal direction of the guide plate 41 (i.e., along the main scanning direction) is disposed to the top surface of the guide plate 41 which is located on the downstream side, and senses the location of the carriage 13 along the Y-axis direction, the speed of the carriage 13 and the direction in which the carriage 13 moves. This linear encoder is disposed so that its sensing surface (which is a surface formed with slits at constant intervals along the Y-axis direction) is along the perpendicular direction.

The structure of the feeding apparatus which feeds sheets will now be described. In this embodiment, disposed are the first sheet feeder cassette 5A and the second sheet feeder cassette 5B which are the two-stage top and bottom cassettes. A first feeding unit 6 and a second feeding unit 17 are attached respectively to the first sheet feeder cassette 5A and the second sheet feeder cassette 5B.

As shown in FIG. 3, the first sheet feeder cassette 5A which is the top cassette (housing part) is housed inside the first bottom case 2*a* in such a manner that the first sheet feeder cassette 5A can move forward and backward, and it is possible to house within the first sheet feeder cassette 5A plural stacked sheets, namely, sheets P which are cut into the A4 size, the letter size, the legal size, the B5 size, the postcard size, etc. Meanwhile, the second sheet feeder cassette 5B which is the bottom cassette (housing part) is housed inside the second bottom case 2*b* in such a manner that the second sheet feeder cassette 5B can move forward and backward, and it is possible to house within the second sheet feeder cassette 5B plural stacked sheets P1 having the same sizes as those housed in the top first sheet feeder cassette 5A except for sheets which are as small as or smaller than postcard size sheets. The second sheet feeder cassette 5B is formed deeper than the first sheet feeder cassette 5A so as to house a great amount of plural sheets P1.

Disposed above the first sheet feeder cassette 5A are the first feeding unit 6, which comprises a sheet feeder roller 7 serving as a feeder rotating body, and a feeding path for feeding a sheet P forward approximately horizontally to the recording unit 10 via a first feeding path 9 which is approximately U-shaped and extends along the vertical direction (FIG. 3) within a rear edge section of the case 2.

At the rear edge of the top first sheet feeder cassette 5A along the sheet feeding direction, a slanted separation plate 15 (separating part) is disposed which separates sheets. The slanted separation plate 15 is formed to have a convexed and curved shape as viewed in the plan view so that it protrudes at the center of a sheet P along the width direction (the Y-axis direction) and drops back toward the both edges, namely, the right-hand edge and the left-hand edge of the sheet P along the width direction. At a position corresponding to a central section of the sheet P along the width direction, an elastic separation member shaped like saw teeth (not shown) is disposed, at the slanted separation plate 15, to abut on the leading edge of the sheet P and facilitate separation.

In the main section of the frame 39, a top end (one end) of an arm member 6*a* of the first feeding unit 6 is mounted to a drive shaft 14 such that the arm member 6*a* can pivot in the vertical direction, and via a gear drive transmission mechanism (not shown) disposed to the arm member 6*a*, power is transmitted from the drive shaft 14 to the sheet feeder roller 7 which is disposed to the distal end (the other end).

As the sheet feeder roller 7 rotating in a predetermined direction (which is counter-clockwise in FIG. 3) and the slanted separation plate 15 cooperate, sheets P stacked in the first sheet feeder cassette 5A are separated one by one and each fed to the first feeding path 9. A torsion spring (not shown) urges the arm member 6*a* always downward.

A slanted separation plate 16 (separating part), which includes an elastic sheet separation member having an approximately similar structure to that of the first sheet feeder cassette 5A, is disposed at the rear edge of the second sheet feeder cassette 5B in the sheet feeding direction. In the second bottom case 2*b*, a top end (one end) of an arm member 17*a* of the second feeding unit 17 is mounted to a drive shaft 18 such that the arm member 6*a* can pivot in the vertical direction. At the distal end (the other end) of the arm member 17*a*, namely, on the farthest side from the drive shaft 18, a distal-end sheet feeder roller 19 serving as a first feeder rotating body is disposed. Meanwhile, in a midstream section of the arm member 17*a* along the longitudinal direction, namely, at the closer location to the drive shaft 18 than the distal-end sheet feeder roller 19, a midstream sheet feeder roller 42 serving as a second feeder rotating body is disposed. The distal-end sheet feeder roller 19 and the midstream sheet feeder roller 42 are disposed in a tandem arrangement, and all feeder rotating bodies are driven to rotate in the same direction via the same drive system. In this embodiment, disposed is a gear drive transmission mechanism 43 which is formed by multiple mesh gears and transmits rotation force of the same direction to the distal-end sheet feeder roller 19 and the midstream sheet feeder roller 42 from the drive shaft 18.

Describing this structure in further detail, as shown in FIGS. 5 and 6A to 6C, a planet gear 44*a* is mounted, so as to be rotatable, to a planet arm 44 which pivots about the drive shaft 18. The planet gear 44*a* is always meshed with a transmission gear 18*a* which rotates integrally with the drive shaft 18 and is mounted to one end of the drive shaft 18. The planet gear 44*a* engages with the upstream-most gear of the gear drive transmission mechanism 43 and transmits power when the drive shaft 18 rotates in the predetermined direction (which is clockwise in FIG. 6A), whereas when the drive shaft 18 rotates counter-clockwise in FIG. 6A, the planet gear 44*a* is released from engagement with the upstream-most gear of the gear drive transmission mechanism 43 and no power will therefore be transmitted.

Further, in the event that the amount of the sheets P1 stacked up within the second sheet feeder cassette 5B is great, that is, equal to or greater than a first predetermined amount, the midstream sheet feeder roller 42 abuts on the top surface of the sheets P1, and as the amount of the stacked sheets P1 decreases to or below a second predetermined amount, the distal-end sheet feeder roller 19 abuts on the top surface of the sheets P1. When the amount of the stacked sheets P1 is smaller than the first predetermined amount and greater than the second predetermined amount, the midstream sheet feeder roller 42 and the distal-end sheet feeder roller 19 abut on the top surface of the sheets P1 at the same time. This happens when the amount of the stacked sheets P1 is smaller by one or a few sheets than the sheets of the first predetermined amount or is greater by one or a few sheets than the sheets of the second predetermined amount.

In this embodiment, the diameters (radii) of the midstream sheet feeder roller 42 and the distal-end sheet feeder roller 19 are substantially the same, and a rotation center of the midstream sheet feeder roller 42 is located closer to a lower section of the arm member 17*a* relative to a linear line which links a rotation center of the drive shaft 18 to that of the distal-end sheet feeder roller 19. In this structure, even when the midstream sheet feeder roller 42 and the distal-end sheet feeder roller 19 abut on the sheets P1 at the same time, no inconvenience occurs such as creation of creases in the sheet P1 which is being fed.

Outer peripheral parts of the cylindrical sheet feeder rollers 7, 19 and 42 are made of a material which may be synthetic rubber or the like (e.g., elastomer, EPDM, etc.), and their surfaces are formed with convex ridges which extend along the perpendicular direction to the sheet feeding direction of the sheets P, P1.

A second feeding path 22 which is approximately U-shaped and extends along the vertical direction (FIG. 3) is provided integrally with the first feeding path 9, across the rear ends of the first bottom case 2*a* and the second bottom case 2*b*. Further, there is a mounting notch (not shown) to and from which the second feeding path 22 can be freely attached and detached. Hence, as the distal-end sheet feeder roller 19 and/or the midstream sheet feeder roller 42 and the slanted separation plate 16 cooperate, the sheets P1 stacked in the second sheet feeder cassette 5B are separated one by one and each fed to the second feeding path 22 and further to the recording unit 10.

Paired registration rollers 20 including a drive roller 20*a* and a driven roller 20*b* are disposed on the upstream side of the sheet feeding direction relative to the platen 11, to thereby send the sheet P or P1 to the bottom surface of the recording head 12. In addition, for feeding the recorded sheet P or P1 toward the sheet discharging part 8 (along the direction denoted at the arrow B in FIG. 3), paired sheet discharging rollers 21 including a discharging roller 21*a* and a spur 21*b* are disposed on the downstream side of the sheet feeding direction relative to the platen 11. The both ends of the drive roller 20*a* and those of the discharging roller 21*a* which drives the spur 21*b* are axially supported, so as to be rotatable, by an axial support section which is disposed to paired side plates 39*b* and 39*c* (FIG. 4) of the frame 39. The sheet P or P1 which is being fed gets nipped (firmly held) between the drive roller 20*a* which is on the top surface side of the sheet P or P1 and the driven roller 20*b* which is on the bottom surface side of the sheet P or P1. The sheet P or P1 is nipped (firmly held) as the discharging roller 21*a* abuts on the bottom surface of the sheet P or P1 which is being thus discharged and the spur 21*b* abuts on the top surface of the sheet P or P1.

Outside the width of thus fed sheet P or P1 (namely, the shorter side of the sheet P or P1), an ink receiver 35 is disposed at one end of the housing 2 (i.e., at a position close to the left-hand side plate 39*b* in FIG. 4 according to this embodiment), while a maintenance unit 36 is disposed at the other end (i.e., at a position close to the right-hand side plate 39*c*) (FIG. 4). For the purpose of preventing nozzles from getting clogged, the ink receiver 35 ejects an ink regularly and receives the ink during recording or at the start of recording when the recording head 12 is at a flashing position. With respect to the maintenance unit 36, a cap part of the maintenance unit 36 covers a nozzle surface of the recording head 12 from below. Further performed is recovery processing for selectively sucking an ink from the nozzles by means of actions of a suction pump (not shown) or for removing air bubbles inside a buffer tank not shown which is disposed above the recording head 12. When the carriage 13 moves from the maintenance unit 36 toward an image recording region along the Y-axis direction, the cap part moves away from the nozzle surface of the recording head 12, thereby executing idle sucking, and a cleaner (wiper blade) wipes the nozzle surface, thereby executing cleaning.

How the second feeding unit 17, in which the arm member 17*a* comprises the distal-end sheet feeder roller 19 and the midstream sheet feeder roller 42, feeds a sheet P1 will now be described in detail. As described above, the arm member 17*a* at its distal end has the distal-end sheet feeder roller 19. The midstream sheet feeder roller 42 is located closer to the pivot center O of the arm member 17*a* than is the distal-end sheet feeder roller 19, and is shifted more toward the stacked sheets than is the distal-end sheet feeder roller 19. Specifically, as FIG. 3 shows, a line La from the pivot center of the arm member 17*a* to the rotation center of the midstream sheet feeder roller 42 is shorter than a line Lb from the pivot center of the arm member 17*a* to a rotation center of the distal-end sheet feeder roller 19, and the rotation center of the midstream sheet feeder roller 42 is shifted toward the top surface of the stacked sheets with the respect to the line Lb.

FIG. 6B illustrates a state that the amount of the sheets P1 stacked up within the second sheet feeder cassette 5B is H2 and that the distal-end sheet feeder roller 19 and the midstream sheet feeder roller 42 are in contact with the surface of the sheet P1 at the same time. It is now assumed that the pivot center of the arm member 17*a* (i.e., the rotation center of the drive shaft 18) is O, a point at which the distal-end sheet feeder roller 19 abuts on the surface of the sheet P1 (first abutting point) is T, and the contained angle between the surface of the sheet P1 and a line connecting the pivot center O with the point T (first contained angle) is θ3. Meanwhile, it is assumed that a point at which the midstream sheet feeder roller 42 abuts on the surface of the sheet P1 (second abutting point) is B, and the contained angle between the surface of the sheet P1 and a line connecting the pivot center O with the point B (second contained angle) is θ2.

It is further assumed that a distance from the pivot center O to the point T is L1 (which will be hereinafter referred to as the "corresponding arm length"; FIG. 6C) and a distance from the pivot center O to the point B is L2 (which will be hereinafter referred to as the "corresponding arm length"; FIG. 6A).

The distal-end sheet feeder roller 19 and the midstream sheet feeder roller 42 have the same diameter. In this case, the circumferential velocities of the both rollers 19 and 42 which are driven to rotate by the same drive system are equal to each other, and therefore, it is possible to feed securely the sheet P1 without causing any inconvenience such as generation of a force to crease or stretch the sheet P1.

FIG. 6A illustrates an instance that the amount of the sheets P1 stacked up within the second sheet feeder cassette 5B is great, that is, the sheets P1 have a height H1 greater than a height H2 (H2<H1). In this example, the distance from the pivot center O of the arm member 17*a* is short, and the midstream sheet feeder roller 42 alone, which is shifted toward the stacked sheets than the distal-end sheet feeder roller 19, abuts on the top surface of the stacked sheets P1. The contained angle in this state is defined θ1.

As more sheets P1 are used beyond the state shown in FIG. 6B, the state shown in FIG. 6C occurs. This is a state that the amount of the stacked sheets P1 is small, that is, the sheets P1 have a height H3 smaller than the height H2 (H2>H3). In this instance, the distal-end sheet feeder roller 19 alone abuts on the top surface of the stacked sheets P1. The contained angle in this state is defined θ4.

When the contained angle θ1 of the midstream sheet feeder roller 42 is set to the minimum optimal angle which will not cause idle sheet feeding and the contained angle θ2 is set to the maximum optimal angle which will not cause double sheet feeding, the corresponding arm length L2 is short, which in turn ensures that the amount of the sheets P1 stacked up within the second sheet feeder cassette 5B (full load amount) is great.

In a similar fashion, when the contained angle θ3 of the distal-end sheet feeder roller 19 is set to the minimum optimal angle which will not cause idle sheet feeding, and a contained angle θ5 (>θ4) of the distal-end sheet feeder roller 19 abutting on a bottom plate (not shown) of the second sheet feeder cassette 5B is set to the maximum optimal angle which will not cause double sheet feeding, the corresponding arm length L1 may be designed to be substantially the same as that in the conventional apparatus.

In other words, when the two sheet feeder rollers 19 and 42 are disposed in a tandem arrangement to the arm member 17*a* as in this embodiment, neither idle sheet feeding nor double sheet feeding occurs even though the full load amount of the sheets P1 in the second sheet feeder cassette 5B increases. On the contrary, when the full load amount of the sheets P1 in the second sheet feeder cassette 5B is set to be the same as that in the conventional apparatus, the range of contained angle θ, which is from the minimum optimal angle which will not cause idle sheet feeding by the sheet feeder rollers 19 and 42 to the maximum optimal angle which will not cause double sheet feeding by the sheet feeder rollers 19 and 42, becomes narrow, thereby achieving an effect that it is possible to realize substantially stable feeding of sheets.

During sheet feeding by only one of the distal-end sheet feeder roller 19 and the midstream sheet feeder roller 42, the other sheet feeder roller rotates idle, which achieves other effect that an excessive load for transmission of power from the drive shaft 18 to the sheet feeder rollers 19 and 42 will not increase.

Although in the above embodiment, the two sheet feeder rollers 19 and 42 are disposed in a tandem arrangement to the arm member 17*a*, three or more sheet feeder rollers may be disposed in a tandem arrangement. In short, the arm member 17*a* mounts, in a tandem arrangement along its longitudinal direction, a first feeder rotating body on its farthest side from the drive shaft 18 and plural second feeder rotating bodies on its closer side to the drive shaft 18 than the first feeder rotating body. All feeder rotating bodies are structured so as to rotate in the same direction via the same drive system. When the amount of the stacked sheets P1 is great, at least one of the second feeder rotating bodies abuts on the top surface of the sheets P1, and as the amount of the stacked sheets P1 decreases, the second feeder rotating bodies abut on the top surface of the sheets P1 sequentially from the one remoter from the first feeder rotating body to the one closer to the first feeder rotating body.

This invention is not limited to the embodiment which has been described above with reference to the associated drawings but may be modified and implemented in various manners to the extent not deviating from the spirit of the invention. For instance, the invention is applicable to an embodiment in which a single sheet feeder cassette or sheet feeder cassettes arranged in three or more stages are disposed.

According to the above-mentioned embodiment, since the first feeder rotating body is disposed to the other end of the arm member and the second feeder rotating body is disposed to a mid section of the arm member, the structure is further simplified.

According to the above-mentioned embodiment, the housing part is a sheet feeder cassette in which the sheets are stacked up substantially horizontally, and may be any sheet feeder cassette having the same structure as those of conventional sheet feeder cassettes.

According to the above-mentioned embodiment, the radii of the first and the second feeder rotating bodies are substantially the same and the rotation center of the second feeder rotating body is shifted toward the top surface of the sheets with respect to the line connecting the pivot center of the arm member with the rotation center of the first feeder rotating body. Therefore, when the respective feeder rotating bodies rotate in the same direction, even though the first and the second feeder rotating bodies are in contact with the surface of the sheet, it is possible to realize stable sheet feeding without generating a force to crease or stretch the sheet which is fed.

According to the above-mentioned embodiment, the power transmission mechanism disposed to the arm member transmits rotation force only for sheet feeding to the first and the second feeder rotating bodies. Therefore, unwanted force will not act upon the surface of the sheet while the sheet is not being fed. Further, it is possible to intermittently feed the sheets one by one in a simple manner.

According to the above-mentioned embodiment, since it is possible for the first and the second feeder rotating bodies to stably separate the sheets one by one and feed each sheet to the image recording part regardless of the amount of the sheets stacked up within the sheet feeder cassette, it is possible to realize an image recording apparatus which is capable of preventing occurrence of sheet jam or the like attributable to the first and the second feeder rotating bodies.

As this description may be embodied in several forms without departing from the spirit of essential characteristics thereof, the present embodiment is therefore illustrative and not restrictive, since the scope is defined by the appended claims rather than by the description preceding them, and all changes that fall within metes and bounds of the claims, or equivalence of such metes and bounds thereof are therefore intended to be embraced by the claims.

What is claimed is:

1. A feeding apparatus comprising:

a housing part comprising a bottom surface configured to hold stacked sheets and a separating part disposed adjacent to the bottom surface at an end of the housing part and configured to separate said stacked sheets one by one;

an arm member configured to pivot about its one end as a pivot center; and a first feeder rotating body disposed far from said one end and a second feeder rotating body disposed closer to said one end than is said first feeder rotating body, said first feeder rotating body and said second feeder rotating body being mounted to said arm member, and configured to separate and feed said stacked sheets one by one while cooperating with said separating part, wherein said first feeder rotating body and said second feeder rotating body are disposed in a tandem arrangement along a longitudinal direction of said arm member and are driven by a power transmission mechanism to rotate in the same direction, and wherein when said arm member pivots, said arm member is configured to maintain the pivot center, a rotation center of said first feeder rotating body, and a rotation center of said second feeder rotating body at constant positions relative to each other, and said arm member is configured to selectively pivot between a first position in which a rotation center of said first feeder rotating body is closer to the bottom surface than a rotation center of said second feeder rotating body, a second position in which the rotation center of said first feeder rotating body and the rotation center of said second feeder rotating body are at equal distance from the bottom surface, and a third position in which the rotation center of said first feeder rotating body is further from the bottom surface than the rotation center of said second feeder rotating body.

2. The feeding apparatus according to claim 1, wherein said first feeder rotating body is disposed to the other end of said arm member, while said second feeder rotating body is disposed to a mid section of said arm member.

3. The feeding apparatus according to claim 1, wherein said arm member is in the third position when the amount of said stacked sheets is equal to or greater than a first predetermined amount.

4. The feeding apparatus according to claim 3, wherein said arm member is in the first position when the amount of said stacked sheets is equal to or smaller than a second predetermined amount which is smaller than the first predetermined amount.

5. The feeding apparatus according to claim 4, wherein said arm member is in the second position when the amount of said stacked sheets is smaller than the first predetermined amount and greater than the second predetermined amount, and wherein said first feeder rotating body and said second feeder rotating body are configured to abut on the top surface of said stacked sheets respectively at a first abutting point and a second abutting point, a distance from the pivot center of said arm member to said first abutting point is longer than a distance from the pivot center of said arm member to said second abutting point, a first angle contained between a line connecting the pivot center with said first abutting point and the top surface of said stack sheets is smaller than a second angle contained between a line connecting the pivot center with said second abutting point and the top surface of said stacked sheets.

6. The feeding apparatus according to claim 5, wherein when said arm member is in the third position, a contained angle between the top surface of said stacked sheets and a line connecting the pivot center of the arm member with a point where the second feeder rotating body abuts on the top surface is smaller than the second contained angle.

7. The feeding apparatus according to claim 5, wherein when said arm member is in the first position, a contained angle between the top surface of said stacked sheets and a line connecting the pivot center of the arm member with a point where the first feeder rotating body abuts on the top surface is greater than the first contained angle.

8. The feeding apparatus according to claim 1, wherein said housing part comprises a sheet feeder cassette in which said sheets are stacked up substantially horizontally.

9. The feeding apparatus according to claim 1, wherein radii of said first and said second feeder rotating bodies are substantially the same, and the rotation center of said second feeder rotating body is shifted toward the bottom surface of the housing part with respect to a line connecting the pivot center of said arm member with the rotation center of said first feeder rotating body.

10. The feeding apparatus according to claim 1, further comprising:

a drive shaft disposed to said one end of said arm member and serving as the pivot center of said arm member, wherein the power transmission mechanism is disposed to said arm member and transmits, when the drive shaft rotates in a predetermined direction, rotation force for feeding said sheets from said drive shaft to said first and said second feeder rotating bodies.

11. The feeding apparatus according to claim 1, further comprising:

a drive shaft disposed to said one end of said arm member and serving as the pivot center of said arm member, wherein the power transmission mechanism is disposed to said arm member and transmits rotation force from said drive shaft to said first and said second feeder rotating bodies, wherein said power transmission mechanism comprises a plurality of gears.

12. The feeding apparatus according to claim 1, wherein said arm member is always urged toward the bottom surface of the housing part.

13. An image recording apparatus comprising:

a feeding apparatus comprising:

a housing part comprising a bottom surface configured to hold stacked sheets and a separating part disposed adjacent to the bottom surface at an end of the housing part and configured to separate said stacked sheets one by one;

an arm member configured to pivot about its one end as a pivot center; and a first feeder rotating body disposed far from said one end and a second feeder rotating body disposed closer to said one end than is said first feeder rotating body, said first feeder rotating body and said second feeder rotating body being mounted to said arm member, and configured to separate and feed said stacked sheets one by one while cooperating with said separating part, wherein said first feeder rotating body and said second feeder rotating body are disposed in a tandem arrangement along a longitudinal direction of said arm member and are driven by a power transmission mechanism to rotate in the same direction, and when said arm member pivots, said arm member is configured to maintain the pivot center, a rotation center of said first feeder rotating body, and a rotation center of said second feeder rotating body at constant positions relative to each other, and said arm member is configured to selectively pivot between a first position in which a rotation center of said first feeder rotating body is closer to the bottom surface than a rotation center of said second feeder rotating body, a second position in which the rotation center of said first feeder rotating body and the rotation center of said second feeder rotating body are at equal distance from the bottom surface, and a third position in which the rotation center of said first feeder rotating body is further from the bottom surface than the rotation center of said second feeder rotating body; and an image recording part which records an image on said sheets which are fed from said feeding apparatus.

* * * * *